US005536438A

United States Patent [19]

Scialla et al.

[11] Patent Number: 5,536,438

[45] Date of Patent: Jul. 16, 1996

[54] MULTI-PURPOSE LIQUID CLEANING COMPOSITION COMPRISING NONIONIC SURFACTANTS OF DIFFERENT HLB VALUES

[75] Inventors: Stefano Scialla; Sergio Cardola, both of Rome; Dario Rapisarda, Mascalucia; Marina Trani, Rome, all of Italy

[73] Assignee: The Procter & Gamble Company, Cincinnati, Ohio

[21] Appl. No.: 432,153

[22] PCT Filed: Nov. 19, 1993

[86] PCT No.: PCT/US93/11294

§ 371 Date: May 5, 1995

§ 102(e) Date: May 5, 1995

[87] PCT Pub. No.: WO94/12600

PCT Pub. Date: Jun. 9, 1994

[30] Foreign Application Priority Data

Nov. 26, 1992 [BE] Belgium ..... 92870191

[51] Int. Cl.[6] ..... C11D 1/825; C11D 1/66; C11D 1/72; C11D 1/722

[52] U.S. Cl. ..... 510/372; 510/394; 510/419; 510/505; 510/535; 510/303; 510/325; 510/280; 510/307; 510/238; 510/422; 510/506

[58] Field of Search ..... 252/174.22, 174.21, 252/DIG. 1, 173, DIG. 14, 142, 170, 143

[56] References Cited

U.S. PATENT DOCUMENTS

| | | | |
|---|---|---|---|
| H1468 | 8/1995 | Costa et al. | 252/174.12 |
| 4,332,692 | 6/1982 | Payne et al. | 252/135 |
| 4,557,898 | 12/1985 | Greene et al. | 422/28 |
| 4,781,923 | 11/1988 | Pellico | 424/130 |
| 4,968,450 | 11/1990 | Kamegai et al. | 252/545 |
| 5,154,850 | 10/1992 | Deguchi et al. | 252/174.17 |
| 5,318,728 | 6/1994 | Surukzdis et al. | 252/548 |
| 5,336,432 | 8/1994 | Petchul et al. | 252/186.28 |

FOREIGN PATENT DOCUMENTS

| | | |
|---|---|---|
| 0540798 | 5/1957 | Canada . |
| 0360743 | 3/1990 | European Pat. Off. . |
| 1540386 | 2/1979 | United Kingdom . |

OTHER PUBLICATIONS

Industrial Chemical Thesaurus, Second Edition 1992 (no mo. available), vol. 2: Tradename to Chemical Cross Reference, definitions of Dobanol 23, Dobanol 25, Dobanol 91 and Lutensol AT surfactants.

McCutcheon's Emulsifiers & Detergents, International Edition 1993 (no mo. available), definitions of Lutensol A and Lutensol AO surfactants.

*Primary Examiner*—Paul Lieberman
*Assistant Examiner*—Ardith Hertzog
*Attorney, Agent, or Firm*—Robert B. Aylor; T. David Reed

[57] ABSTRACT

Mildly acidic multi-purpose liquid cleaning compositions which comprise a specific nonionic surfactant system are disclosed. The nonionic surfactant system comprises at least four different nonionic surfactants belonging to four different HLB classes. The compositions can be used for laundering, hard surface cleaning for bathrooms, kitchens or floors, as well as for cleaning carpets.

11 Claims, No Drawings

MULTI-PURPOSE LIQUID CLEANING COMPOSITION COMPRISING NONIONIC SURFACTANTS OF DIFFERENT HLB VALUES

TECHNICAL FIELD

The present invention relates to the field of detergent or cleaning compositions. The compositions of the present invention are multi-purpose cleaning compositions which are suitable for use as hard-surface cleaners, carpet cleaners as well as in laundry applications.

BACKGROUND

A wide variety of cleaning compositions have been described in the art. Typically, cleaning compositions can be divided into hard surface cleaning compositions and laundry cleaning compositions. Cleaning compositions of these two types are traditionally very different in formulation and are sold as different products with different marketing concepts. These differences impose on the consumer to have to purchase and use at least two different products. Furthermore, compositions of the two types above, especially hard surface cleaners, can be divided into sub-typos. Indeed, many different kinds of hard-surface cleaners are available, for instance bathroom cleaners, kitchen cleaners or floor cleaners.

This variety in formulation is rendered necessary by the difference in nature between the soils which can be found on laundry and on various surfaces in kitchens, floors including carpets and bathroom. For instance, kitchen soils comprise mainly edible oils, while bathroom soils comprise mainly sebum and soap scum, also limescale; floor soils comprise mainly particulate soils and laundry may have many different soils and stains.

It is the object of the present invention to formulate a multi-purpose liquid cleaner which can be satisfactorily used on various surfaces as well as in laundry applications, to clean various soils and stains. The compositions according to the present invention should also be able to perform in a variety of conditions, i.e. in hard and soft water. They should also provide satisfactory shine performance and surface safety when used as hard surface cleaners.

It has now been found that this object can be simply and efficiently met by formulating a cleaning composition which comprises a specific nonionic surfactant system in a mildly acidic range. Indeed it has been found that combining nonionic surfactants belonging to four different HLB (hydrophilic-lipophilic balance) classes provides a cleaning composition which exhibits a great flexibility in the soils it may clean. Furthermore, it has been found that said surfactants of said four clams act in synergy in cleaning most type of soils. Furthermore still, it has been found that adding hydrogen peroxide to this nonionic surfactant system delivers stronger cleaning performance especially in laundry applications.

SUMMARY OF THE INVENTION

The present invention is an aqueous cleaning composition having a pH of from 0.5 to 6, said composition comprising from 2% to 40% by weight of the total composition of a nonionic surfactant system, whereby said nonionic surfactant system comprises:

At least one nonionic surfactant with an HLB above 15;

At least one nonionic surfactant with an HLB of from above 13 to 15;

At least one nonionic surfactant with an HLB of from 9 to 13;

At least one nonionic surfactant with an HLB below 9.

Highly preferred compositions herein further comprise hydrogen peroxide.

DETAILED DESCRIPTION OF THE INVENTION

The compositions according to the present invention are aqueous liquid cleaning compositions. Said aqueous compositions have a pH as is of from 0.5 to 6, preferably I to 5, most preferably from 2 to 4.5. The pH of the compositions can be adjusted by using organic or inorganic acids, or alkalinizing agents.

The compositions according to the present invention further comprise a specific nonionic surfactant system comprising at least four nonionic surfactants. Said nonionic surfactant system is efficient in cleaning a variety of different soils, and significant cooperation has been observed between the four different types of surfactants.

The nonionic surfactant system herein comprises a mixture of at least four different nonionic surfactants, each of which lies in a specified HLB (hydrophilic-lipophilic balance) range. The compositions of the present invention thus clean a variety of soils from particulate to nonparticulate soils, from hydrophilic to hydrophobic soils.

Accordingly, the nonionic surfactant system according to the present invention comprises:

At least one nonionic surfactant with an HLB above 15, hereinafter referred to as highly hydrophilic surfactant;

At least one nonionic surfactant with an HLB of from above 13 to 15, hereinafter referred to as hydrophilic surfactant;

At least one nonionic surfactant with an HLB of from 9 to 13, hereinafter referred to as hydrophobic surfactant;

At least one nonionic surfactant with an HLB below 9, hereinafter referred to as highly hydrophobic surfactant.

Suitable nonionic surfactants for the implementation of said surfactant system are fatty alcohol ethoxylates which are commercially available with a variety of fatty alcohol chain length and a variety of ethoxylation degrees. By simply varying the length of the chain of the fatty alcohol and the degree of ethoxylation, fatty alcohol ethoxylates can be obtained with different HLB values. Accordingly, suitable highly hydrophilic surfactants for use herein are Lutensol$^R$ AO30 (HLB=17) or Lutensol$^R$ AT 25 (HLB= 16) or AT 50 (HLB=18) or AT 80 (HLB=18.5). Suitable hydrophilic surfactants for use herein are Dobanol$^R$ 91-8 (HLB=13.7) or 91-10 (HLB=14.7).

Suitable hydrophobic surfactants for use herein are Dobanol$^R$ 23-6.5 (HLB=I 1.9) or Dobanol$^R$ 25-7 (HLB=12) or Dobanol$^R$ 91-5 (HLB=I 1.6) or Dobanol$^R$ 91-6 (HLB= 12.5). Suitable highly hydrophobic surfactants for use herein are Dobanol$^R$ 23-3, Lutensol$^R$ AO3, Dobanol$^R$ 91-2.5 and Dobanol$^R$ 23-2.

In the compositions according to the present invention, said nonionic surfactants belonging to the four classes described hereinabove act in synergy, particularly on kitchen dirt soils and bathtub soils. It is thus possible to use low total levels of said nonionic surfactant system. The compositions according to the present invention comprise from 40% down to 2% by weight of the total composition of said nonionic surfactant system, preferably from 15% to 3%.

It has been found that: in order to obtain the best cleaning performance on kitchen dirt soils, it is preferable to use a nonionic surfactant system according to the present invention wherein the weight ratio of highly hydrophilic surfactant to hydrophilic surfactant is at most 1:1.5, and wherein the combined amount of said highly hydrophilic and hydrophilic surfactant in the total composition is at least 2% by weight, preferably at least 2.5%.

It has also been found that, in order to obtain the best cleaning performance on bathtub soils, it is preferable to use a nonionic surfactant system according to the present invention wherein the weight ratio of highly hydrophobic to hydrophobic surfactant is from 1.5:1 to 2.5:1, preferably 2:1, and wherein the combined amount of said hydrophobic and highly hydrophobic nonionic surfactant in the total composition is at least 1.5% by weight.

The compositions according to the present invention may further comprise additional nonionic surfactants, i.e. there can be more than one surfactant in each class hereinabove. The compositions according to the present invention do not require the use of an anionic surfactant system. Accordingly, the compositions according to the present invention are preferably free of anionic surfactants.

In multi-purpose cleaning compositions, it is essential to control the suds profile of the composition. Indeed, too much foaming is likely to be detrimental to shine, and makes rinsing troublesome for the consumer. Furthermore, oversudsing will also be an issue as the composition is used in a laundry washing machine. Controlling foaming is even more of an issue in acidic conditions where fatty acids, which are traditionally used as suds suppressors, cannot be used because they tend to be insoluble in such conditions. It is also advisable to avoid the use of silicone-based suds suppressors which are detrimental to the stability of hydrogen peroxide and the aesthetics of the product.

An additional advantage of the compositions herein is that said nonionic surfactant system presents a good suds profile and therefore does not require the use of a suds suppressing ingredient. It has been found that, for an optimum suds profile, it is preferable to use a nonionic surfactant system according to the present invention wherein the weight ratio of the sum of the highly hydrophilic and hydrophilic surfactants to the highly hydrophobic surfactant is of 1.5:1 or more.

If however an even lower suds profile is desired, it may be suitable to use appropriate suds suppressing systems such as 2-alkyl alkanols, as described for instance in DE 40 21 265 and co-pending European patent application 92870174.7. Such suitable compounds are commercially available, for instance in the ISOFOL @ series such as ISOFOL @ 12 (2-butyl octanol) and ISOFOL @]16 (2-hexyl decanol). Preferred 2-alkyl alkanols for use herein have an alkyl chain comprising from 6 to 16 carbon atoms, preferably 8 to 12, and a terminal hydroxy group, said alkyl chain being substituted in the α position by an alkyl chain comprising from 1 to 10 carbon atoms, preferably 2 to 8, more preferably 3 to 6. However we have found that there is a problem associated with the use of such ingredients in that they may cause the final product to appear hazy, indicating insolubility and phase separation. We have found that this problem could be solved and a clear product could be obtained in a broad range of temperatue, e.g. up to 50° c., by using an appropriate class of brighteners which, in addition to performing their brightening action upon use, increase the cloud point of the solution. The selected brighteners belong to the class of distyryl diphenyl brighteners, in particular 4-4'-his[2-2'styryl sulfonate] biphenyl, commercially available from Ciba-Geigy under the trade name Tinopal CBS-X @. The appropriate amount of brightener to be used depends on the particulars of the surfactant system and the 2-alkyl alkanol chosen, but can be determined by simple trial and error.

In a highly preferred embodiment of the invention, compositions herein preferably comprise from 2% to 15% by weight of the total composition of hydrogen peroxide or a source thereof. Indeed, the presence of hydrogen peroxide provides strong cleaning benefits which are particularly noticeable in laundry applications. Furthermore, the nonionic surfactant system for use in the compositions according to the present invention is remarkably compatible with hydrogen peroxide in that good hydrogen peroxide storage stability was observed, even in the absence of hydrogen peroxide stabilizers. Furthermore still, ingredients which are typically sensitive to hydrogen peroxide, such as dyes or brighteners, appear to be stable upon storage in the compositions according to the present invention without having to add stabilizers for that purpose.

The compositions according to the present invention may further comprise a variety of optional ingredients such as builders, solvents, perfumes and dyes.

The compositions according to the present invention can be used as a household cleaner in the bathroom or in the kitchen, and can also be used as a laundry detergent or as a laundry detergent booster. When used as hard surface cleaners, the compositions according to the present invention am easy to rinse and provide good shine characteristics on the cleaned surfaces. The compositions according to the present invention, especially when formulated with hydrogen peroxide, are also particularly effective as carpet cleaners. If used as carpet cleaners, the compositions according to the present invention am advantageously dispensed with a spray dispenser and left to act on said carpets.

EXAMPLES

The following compositions were made by mixing the listed ingredients in the listed proportions (weight % unless otherwise specified). The compositions in the examples were tested and proved satisfactory on cleaning laundry, kitchen dirt soils as well as bathtub soils. Furthermore, the stability of hydrogen peroxide, brightener and dye was monitored and proved satisfactory at 50° c. for two weeks.

| | I | II | III | IV | V |
|---|---|---|---|---|---|
| Lutensol$^R$ AO 30 | 0.75 | 1.50 | 0.75 | 0.75 | 0.75 |
| Dobanol$^R$ 91-10 | 2.60 | 3.00 | 2.60 | 2.60 | 2.60 |
| Dobanol$^R$ 23-6.5 | 0.90 | 0.50 | 0.90 | 0.90 | 0.90 |
| Dobanol$^R$ 23-3 | 1.75 | 1.00 | 1.00 | 1.00 | 1.00 |
| $H_2O_2$ | 7.00 | 7.00 | 7.00 | 7.00 | 7.00 |
| Tinopal$^R$ CBS X (1) | 0.10 | 0.10 | 0.10 | 0.06 | 0.06 |
| Cosmenyl$^R$ A2R (2) | 6 ppm | 6 ppm | 6 ppm | 6 ppm | 6 ppm |
| $H_2SO_4$ up to pH | 4.00 | 4.00 | 4.00 | 4.00 | 4.00 |
| 2-Butyl Octanol | — | — | 0.75 | 0.75 | — |
| 2-hexyl decanol | — | — | — | — | 0.30 |
| Water and minors | | | up to 100% | | |

All compositions were clear products with more than 90% transmittance at 600 nm at room temperature. (1) is a distyryl diphenyl brightener commercially available from Ciba-Geigy. (2) is a dye commercially available from Hoechst.

What is claimed is:

1. An aqueous controlled foaming cleaning composition having a pH of from 1 to 5, said composition comprising from 2% to 40% by weight of the total composition of an nonionic surfactant system, characterized in that said nonionic surfactant system comprises:

At least one highly hydrophilic nonionic surfactant with an HLB above 15;

At least one hydrophilic nonionic surfactant with an HLB of from above 13 to 15;

At least one hydrophobic nonionic surfactant with an HLB of from 9 to 13;

At least one highly hydrophobic nonionic surfactant with an HLB below 9.

2. A composition according to claim 1 which comprises from 3% to 15% by weight of the total composition of said nonionic surfactant system.

3. A composition according to claim 1 which is substantially free of anionic surfactants.

4. A composition according to claim 1 which comprises from 2% to 15% by weight of the total composition of hydrogen peroxide, or a source thereof.

5. A composition according to claim 1 wherein the weight ratio of highly hydrophilic surfactant to hydrophilic surfactant is at most 1:1.5, and wherein the combined amount of said highly hydrophilic and hydrophilic nonionic surfactants in the total composition is at least 2% by weight.

6. A composition according to claim 1 wherein the weight ratio of highly hydrophobic to hydrophobic surfactant is from 1.5:1 to 2.5:1, and wherein the combined amount of said hydrophobic and highly hydrophobic nonionic surfactants in the total composition is at least 1.5% by weight.

7. A composition according to claim 1 wherein the weight ratio of the sum of highly hydrophilic and hydrophilic surfactants to highly hydrophobic nonionic surfactant is 1.5:1 or more.

8. A composition according to claim 1 which further comprises a brightener and a dye.

9. A composition according to claim 1 which further comprises a suds suppressing or suds decreasing amount of a 2-alkyl alkanol.

10. A clear composition according to claim 9 which comprises a distyryl diphenyl brightener.

11. A clear composition according to claim 10 where said distyryl diphenyl brightener is 4-4'-bis[2-2'styryl sulfonate] biphenyl.

* * * * *